United States Patent [19]

Eggenberger

[11] 4,422,310

[45] Dec. 27, 1983

[54] TENSIONING DEVICE

[76] Inventor: Larry Eggenberger, 616 NW. Lorna St., Burleson, Tex. 76028

[21] Appl. No.: 298,280

[22] Filed: Sep. 1, 1981

[51] Int. Cl.[3] ..... C14B 1/26

[52] U.S. Cl. ..... 69/19.3

[58] Field of Search ..... 69/19.1, 19.2, 19.3

[56] References Cited

U.S. PATENT DOCUMENTS

| | | |
|---|---|---|
| 909,123 | 1/1909 | Ruppel . |
| 1,120,798 | 12/1914 | Duecker . |
| 1,338,050 | 4/1920 | Tucker . |
| 1,657,464 | 1/1928 | Fogg . |
| 1,756,103 | 4/1930 | Slebodnik . |
| 2,147,039 | 2/1939 | Johanson . |
| 2,290,457 | 7/1942 | Taylor . |
| 3,285,480 | 11/1966 | Estephanian . |
| 3,391,635 | 7/1968 | Matheus ..... 69/19.3 |

*Primary Examiner*—Patrick D. Lawson

*Attorney, Agent, or Firm*—Charles D. Gunter, Jr.

[57] ABSTRACT

A device for tensioning leather and leather-like materials prior to stitching includes a pallet and a pair of base strips mounted on the pallet in spaced-apart relationship. Each of the base strips has an inner edge for receiving an outer opposing edge of the material to be stitched. Pivoting bars mounted on each of the base strips by toggle mechanisms have pins on the underside thereof which pierce the material edges and are received in corresponding holes located in the base strips. One edge of the material is placed along the inner edge of one of the base strips and clamped in place by one of the pivoting bars. The opposing edge of the material to be stitched is then placed along the inner edge of the other base strip and the other pivoting bar is brought into longitudinal alignment with the base strip, thereby clamping and tensioning the material prior to stitching.

3 Claims, 4 Drawing Figures

49
33
37
35
45
41
51
63
55
80
59
17
39
37
35
89
37
43
53
11
21
63
15
31
29
25
57
78
37
47
35
19
21
13
23
27

TENSIONING DEVICE

BACKGROUND OF THE INVENTION

The present invention relates generally to clamping and tensioning devices for leather and leather-like materials and specifically for clamping and tensioning devices used to locate and hold the upper portion of a leather boot while stitching decorative thread patterns in the leather with an automatic stitching machine.

Western style "cowboy" boots are manufactured by sewing together upper portions of leather known as "quarters". The quarter, which can be either leather, leather-like material, or a synthetic substitute, is clamped into a frame or fixture known as a "pallet". The pallet locates or orients the boot quarter and holds the same in place so that decorative thread patterns can be stitched in the boot quarter with an automatic stitching machine.

Prior pallet designs clamped the outer opposing edges of the boot quarter onto the sides of the frame. The leather was not necessarily drawn taunt, and close rows of the decorative stitches would often overlap, ruining the quarter, which would then be rejected or would require reworking.

A need exists, therefore, for a device which will not only properly locate the boot quarter in the pallet and support the same for stitching, but which will also tension the quarter so that close rows of stitches will not overlap.

SUMMARY OF THE INVENTION

The tensioning device for leather and leather-like materials of this invention has a pallet and a pair of base strips mounted on the pallet in spaced-apart relationship. Each of the base strips has an inner edge adapted to receive an opposing edge of material to be stitched. Tensioning means on at least one of the base strips clamp and tension the material located between the base strips.

Preferably, the tensioning means is a pivoting bar mounted on each of the base strips. Each of the pivoting bars is pivotable between an open position for receiving the outer opposing edges of material to be stitched and a closed position longitudinally aligned with the inner edges of the base strips. The bars are provided with a plurality of pins on the underside thereof which are adapted to pierce the material edges. The base strip inner edges have corresponding holes selectively positioned for receiving the pins when the bars are in the closed position, whereby the action of the pins in piercing the material edges and entering the holes serves to tense the material in the pallet.

In the method of clamping and tensioning the outer opposing edges of a material to be stitched, a pallet is provided with a pair of adjustable base strips mounted on the pallet in spaced-apart relationship. Each of the strips has an inner edge adapted to receive an opposing edge of material to be stitched. A pivoting bar is mounted on each of the base strips. The bars are pivotable between an open position for receiving the outer opposing edges of material to be stitched and a closed position longitudinally aligned with the inner edges of the base strips for clamping and tensioning the material.

One edge of a material to be stitched is placed along the inner edge of one of the base strips and clamped with one of the pivoting bars. The opposing edge of the material to be stitched is then placed along the inner edge of the other of the base strips and the other pivoting bar is moved to the closed position to tension the material. The pallet carrying the taunt material can then be positioned on an automatic stitching machine and be stitched.

Additional objects, features, and advantages will be apparent in the following description.

DETAILED DESCRIPTION OF THE INVENTION

Figure 1:
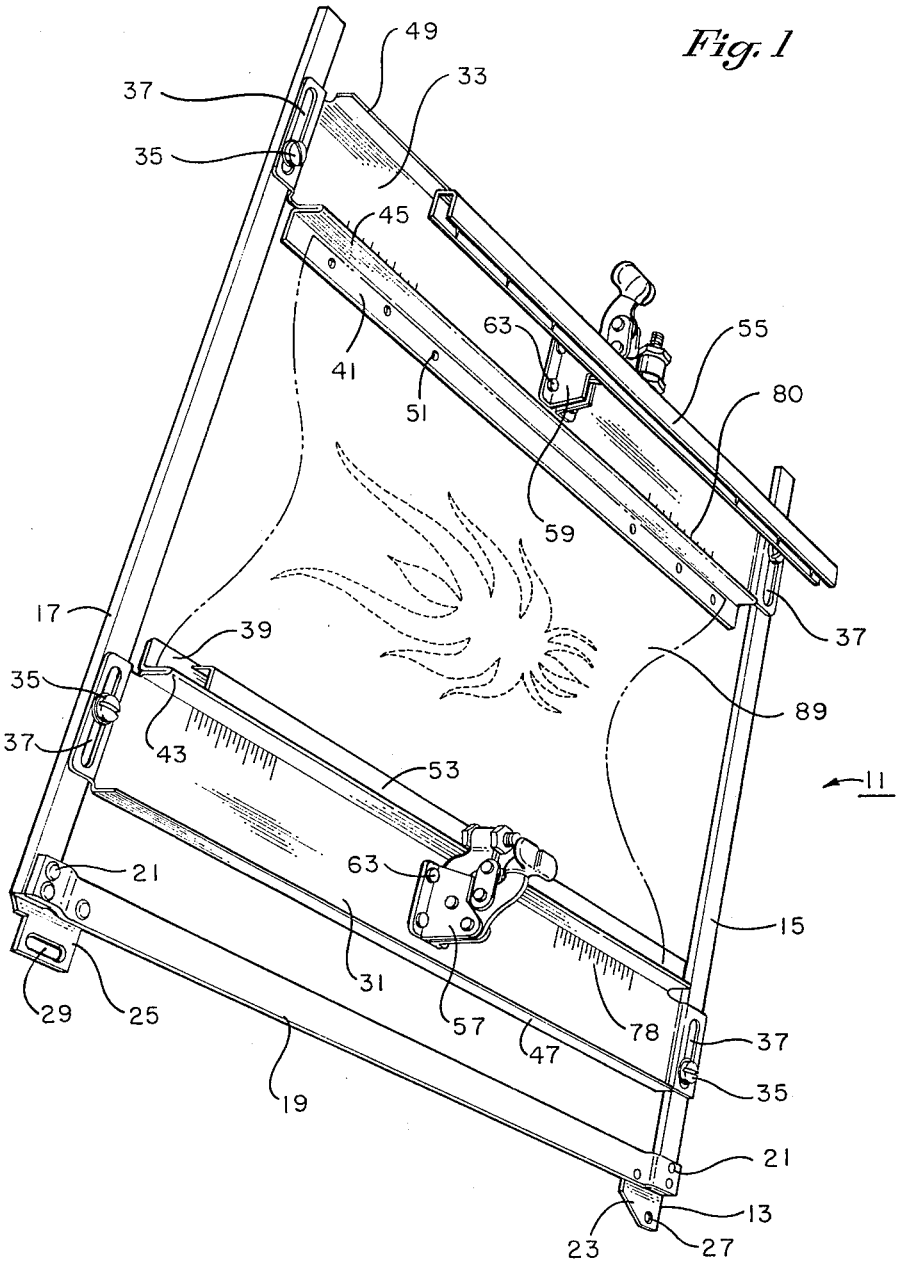
FIG. 1 is a perspective view of the tensioning device for stitching fabric showing one of the pivoting bars in the open position.

FIG. 1 shows a tensioning device 11 which includes a frame or pallet 13 comprising spaced-apart longitudinal strips 15, 17 which are connected by a crossbar 19. Rivets 21 in the ends of crossbar 19 maintain strips 15, 17 in parallel relationship. Mounting brackets 23, 25 having holes 27, 29 are provided for mounting the pallet 13 on an automatic stitching machine (not shown) of the type known to those familiar with the boot stitching industry.

Pallet 13 is provided with a pair of adjustable base strips 31, 33 which are mounted on pallet 13 in spaced-apart relationship by means of screws 35 located in slots 37. Each base strip 31, 33 has an inner edge 39, 41, an inner lip 43, 45, and an outer lip 47, 49. Inner edges 39, 41 are provided with a plurality of holes 51. Base strips 31, 33 are preferably constructed from a thin, flexible, metallic material, preferably stainless steel or aluminum. Base strips 31, 33 are preferably about 0.25–1.50 mm thick.

A "U-shaped" pivoting bar 53, 55 is mounted on each of the base strips 31, 33 at the approximate midpoint thereof. Pivoting bars 53, 55 are mounted on base strips 31, 33 by means of identical overcenter camming or toggle mechanisms 57, 59. Pivoting bars 53, 55, toggle mechanisms 57, 59, and base strips 31, 33 comprise tensioning means on the base strips for clamping and tensioning material 89 (shown in dotted lines in FIG. 1) located between the base strips.

Figure 2:
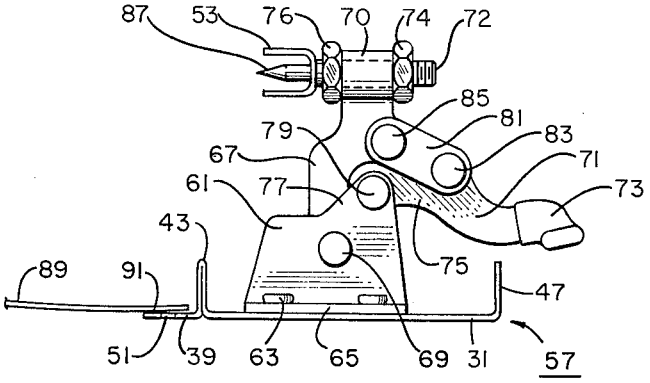
FIG. 2 is a side perspective view of a portion of the tensioning device of FIG. 1 showing the pivoting bar in the open position.

The tensioning means are shown in greater detail in FIG. 2. Toggle mechanism 57 includes a divided body portion 61 which is fixed to base strip 31 by rivets 63 on outwardly extending flanges 65. A bar linkage 67 is pivotally secured within divided body 61 at a central pivot point 69 and has a cylindrical opening or flange portion 70 at the end thereof opposite pivot point 69. A thumb linkage 71 having a thumb pad 73 at one end thereof is secured at the opposite end 75 within the upper portion 77 of divided body 61 at an upper pivot point 79. Thumb linkage 71 is attached at the approximate mid portion thereof to bar linkage 67 by an intermediate linkage 81 having first and second pivot points 83, 85, respectively.

Each of the U-shaped pivoting bars 53, 55 is connected to a bar linkage 67 by means of a threaded shaft 72 which is received within a cylindrical opening 70 in bar linkage 67 and retained therein by upper and lower nuts 74, 76, respectively. Each of the U-shaped pivoting bars 53, 55 is provided with a plurality of pins 87 on the underside thereof which are adapted to pierce the material edges. Pins 87 are positioned on the underside of pivoting bars 53, 55 so that the position of pins 87 corresponds to the position of the holes 51 in inner edges 39, 41 of base strips 31, 33 whereby pins 87 are received within holes 51 when bars 53, 55 are in the closed position shown in FIG. 4.

As shown in FIG. 1, the base strips 31, 33 can be provided with a series of indexing lines 78, 80 positioned along and at generally right angles to inner lips 43, 45. By fixing an indexing point on the material to be stitched and aligning the same with lines 78, 80 on base strips 31, 33, the material can be properly located in pallet 13 prior to stitching.

The method of clamping and tensioning the outer opposing edges of a lether or leather-like material to be stitched using the present invention will now be described. As shown in FIG. 1, a pallet 13 is provided with a pair of adjustable base strips 31, 33 mounted on the pallet 13 in spaced-apart relationship. Base strips 31, 33 are slidably adjustable by means of screws 35 in slots 37 so that the distance between the inner edges 39, 41 of strips 31, 33 can be selectively varied. In this way, wider or narrower or even tapered quarters of material can be accommodated. The inner edges 39, 41 of base strips 31, 33 are adapted to receive an opposing edge of the material to be stitched.

Figure 4:
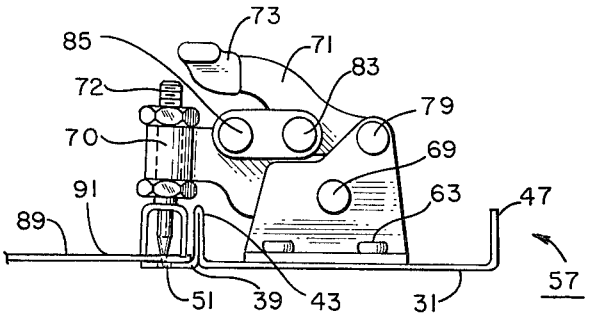
FIG. 4 is similar to FIG. 3 but shows the pivoting bar in the fully closed position.

A pivoting bar 53, 55 is mounted on each of the base strips 31, 33 and is pivotable between an open position as shown in FIG. 2 for receiving the opposing edges of material to be stitched and a closed position as shown in FIG. 4 longitudinally aligned with the inner edges 39, 41 of the base strips 31, 33 for clamping and tensioning the material.

In tensioning the material prior to stitching, one edge of the material to be stitched is placed along the inner edge 39 of the base strip 31 and clamped by moving toggle mechanism 57 to the closed position shown in FIGS. 1 and 4.

The opposing edge of the material to be stitched is then placed along the inner edge 41 of base strip 33 and the material is tensed by moving the other toggle mechanism 59 to the closed position.

Figure 3:
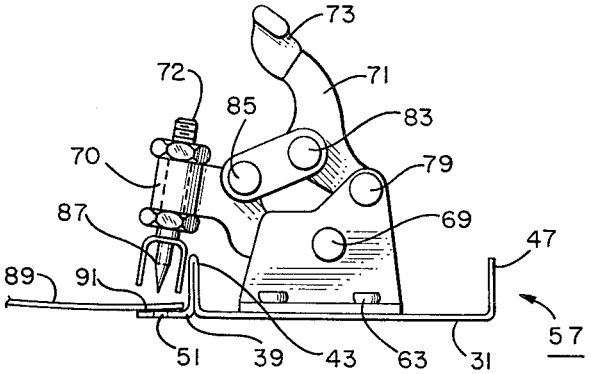
FIG. 3 is similar to FIG. 2 but shows the pivoting bar moving to the closed position.

The operation of the toggle mechanism in tensing the material can be best understood by reference to FIGS. 2, 3 and 4. In FIG. 2, a piece of material 89 to be stitched has been clamped at one edge and has an opposing edge 91 which has been placed on inner edge 39 of base strip 31. As shown in FIG. 2, a slight gap exists between the opposing edge 91 of material 89 and inner lip 43 of base strip 31.

The toggle mechanism is then moved to the over center, closed position as shown in FIGS. 3 and 4 by pivoting thumb linkage 71 about pivot point 79 causing pivoting bar 53 to move in a circumferential arc about pivot point 79 whereby pins 87 are brought into contact with opposing edge 91. As toggle mechanism 57 moves to the over center closed or cammed position shown in FIG. 4, pins 87 on bar 53 pierce edge 91 of fabric 89 and are received within holes 51 in inner edge 39. As shown in FIG. 4, the action of pins 87 piercing material 89 and passing into holes 51 along with the overcenter movement of bar linkage 67, causes material 89 to be pulled taunt against inner lip 43. The thin, flexible metallic material of which base strips 31, 33 are formed allows strips 31, 33 to flex whereby outer lips 47, 49 are drawn up and inward toward inner lips 43, 45 as the pins 87 pierce the material 89 and enter holes 51. This action also assists in tensing the material 89 between base strips 31, 33 as thumb pressure is removed from thumb pad 73 and outer lips 47, 49 return to their normal unflexed positions.

An invention has been provided with significant advantages. The tensioning device clamps and tensions a boot quarter in a pallet prior to stitching with an automatic stitching machine. By securely locating the boot quarter in the pallet and maintaining the same in a taunt condition, close decorative stitching can be accomplished without overlaying rows of stitches. In one sewing factory alone, the projected savings in rework time and reject materials has been estimated at $350,000 over a one year period. The present device is simple in operation and economical to manufacture.

While the invention has been shown in only one of its forms, it should be apparent that it is not thus limited but is susceptible to various changes and modifications without departing from the spirit thereof.

I claim:

1. Method of clamping and tensioning a boot quarter prior to stitching, comprising the steps of:

providing a pallet with a pair of adjustable base strips mounted on said pallet in spaced-apart relationship, each of said strips having an inner edge adapted to receive an opposing edge of the boot quarter to be stitched;

mounting a pivoting bar on each of said base strips by a toggle mechanism, said bars being pivotable between an open position for receiving the opposing edges of the boot quarter to be stitched and a closed position longitudinally aligned with the inner edges of said base strips for clamping and tensioning said boot quarter;

providing said pivoting bars with a plurality of pins on the underside thereof adapted to pierce said boot quarter edges and providing said base strip inner edges with corresponding holes selectively positioned for receiving said pins when said bars are closed;

placing one edge of the boot quarter to be stitched along said inner edge of one of said base strips and clamping said boot quarter edge onto said inner edge with one of said pivoting bars; and placing the opposing edge of the boot quarter to be stitched along the inner edge of the other of said base strips and tensioning the boot quarter by moving the other of said pivoting bars to the closed position.

2. A tensioning device for use in clamping and tensioning material prior to stitching, comprising:

a pallet;

a pair of base strips mounted on said pallet in spaced-apart relationship, each of said base strips having an inner edge adapted to receive an opposing edge of material to be stitched;

a pivoting bar mounted on each of said base strips for clamping and tensioning material located between said base strips, each of said bars being mounted on said base strips by a toggle mechanism;

said pivoting bars being pivotable between an open position for receiving the opposing edges of material to be stitched and a closed position longitudinally aligned with the inner edges of said base strips; and wherein said bars are provided with a plurality of pins on the underside thereof adapted to pierce said material edges and wherein said base strip inner edges have corresponding holes selectively positioned for receiving said pins when said bars are in the closed position, whereby the action of said pin in piercing said material edges and entering said holes serves to tense said material in said pallet.

3. A method of clamping and tensioning a boot quarter prior to stitching, comprising the steps of:

providing a pallet with a pair of adjustable base strips mounted on said pallet in spaced-apart relationship, each of said strips having an inner edge adapted to receive an opposing edge of the boot quarter to be stitched;

mounting a pivoting bar on each of said base strips by a toggle mechanism, said bars being pivotable between an open position for receiving the opposing edges of the boot quarter to be stitched and a closed position longitudinally aligned with the inner edges of said base strips for clamping and tensioning said boot quarter;

providing said pivoting bars with piercing means on the underside thereof adapted to pierce said boot quarter edges and providing said base strip inner edges with corresponding holes selectively positioned for receiving said piercing means when said bars are closed;

placing one edge of the boot quarter to be stitched along said inner edge of one of said base strips and clamping said boot quarter edge onto said inner edge with one of said pivoting bars; and placing the opposing edge of the boot quarter to be stitched along the inner of the other of said base strips and clamping and tensioning the boot quarter in one step by moving the other of said pivoting bars to the closed position.

* * * * *